United States Patent [19]

King

[11] 4,003,305

[45] Jan. 18, 1977

[54] PRESS FRAME

[76] Inventor: Roy L. King, Rte. 11, Staunton Bridge Road, Greenville, S.C. 29611

[22] Filed: Apr. 27, 1976

[21] Appl. No.: 680,726

[52] U.S. Cl. ..... 100/257; 29/251; 248/423

[51] Int. Cl.[2] ..... B30B 15/06

[58] Field of Search ..... 100/214, 257; 83/527, 83/641; 248/125, 423; 29/251; 72/445, 448

[56] References Cited

UNITED STATES PATENTS

| | | | |
|---|---|---|---|
| 1,408,450 | 3/1922 | Gilson | 29/251 |
| 2,387,839 | 10/1945 | Frost | 100/266 |
| 2,502,072 | 3/1950 | Bender | 83/641 |
| 2,877,705 | 3/1959 | Wilson | 100/214 |
| 3,676,915 | 7/1972 | Ireland | 100/257 X |

*Primary Examiner*—Billy J. Wilhite
*Attorney, Agent, or Firm*—Bailey, Dority & Flint

[57] ABSTRACT

A press machine comprising a frame having a pair of spaced legs, and adjustable press bed transversely carried on the legs so as to be adjustable in position along the length thereof wherein abutment supporting blocks carried on the frame legs support abutment members for supporting the press bed. A bridge plate is secured to the legs and extends over the abutment supporting blocks for aiding in retaining the abutment member while increasing the structural integrity of the frame legs so as to increase the load capacity thereof.

6 Claims, 3 Drawing Figures

PRESS FRAME

Background of the Invention

Press machines normally utilizing a hydraulic, mechanical or pneumatic jack means have been used for many years for fitting and removing press fitted bearings and the like on a shaft or axle. Generally, the press machine frame comprises a pair of spaced-apart leg members which adjustably support a press bed. The jack means is carried by the press frame above the press bed and has a ram pin for engaging a workpiece supported on the press bed. As the ram pin presses against the workpiece large loads are placed on the press frame, particularly on the frame portions which support the press bed.

With the modern day application of such press machines to much heavier work loads such as pulling and replacing bearings on the axles of large freight trucks and mill shaft work, the press frames must be capable of withstanding increasing loads. Present day press machines are being constructed with load capacities of up to 500 tons.

Since the press bed necessarily must be supported in an adjustable manner along the length of the frame legs, these frame portions quite often are the first to develop fatigue and failure. Prior press machines which adjustably support the press bed are shown in United States Letters Patent Nos. 2,387,839 and 2,502,072 wherein pins carried in slots and holes, respectively, may be removably placed so as to vary the position of the press bed. The use of holes drilled in the side flanges of the frame leg has been the most commonly practiced structure for providing adjustable placement of the pins which support the press bed.

However, the holes in the frame legs must be precision drilled through hard steel which is costly and if the holes in opposing flanges are not perfectly aligned, the likelihood of shearing and breakage of the pin when placed under a load is increased. In addition, the drilling of holes in the flanges of the frame legs reduced the structural integrity of the legs and the frame structure. In this weakened condition, the frame legs have an increased tendency to bow outwardly under large compressive loading often resulting in structural failure. This is also true of other press machine frame configurations where material is drilled or otherwise cut out of the flanges of the frame legs to accommodate variable placement of the bed supporting pin member.

The prior apparatus for adjustably positioning the press bed does not appear structurally sufficient for modern day press machines having increased load capacities.

SUMMARY OF THE INVENTION

It has been found that a press machine can be provided with an improved frame for adjustably positioning the press bed of the machine. A press machine generally comprises a pair of spaced parallel leg members, a cross beam member bridging the ends of the leg members adjacent one of the ends thereof, a second cross beam member bridging the remote ends of the leg members, a press bed carried transversely by the leg members being adjustable in position along the length thereof intermediate the first and second cross beam members, and a jack means carried by the first cross beam member having a ram pin movable towards the press bed for engaging a workpiece supported on the bed. The improved frame apparatus comprises at least one abutment supporting element carried on each of the leg members for supporting an abutment member. the press bed has a lower surface disposed adjacent the members for being supported on the abutment members at a desired position along the length of the leg members. A bridge member is carried by each leg member and spans the abutment supporting elements to define a space between a respective leg member and bridge plate member between which the abutment member is restrained on the supporting element while providing increased strength to said leg members reducing the tendency of said leg members to bow outwardly under increased stress.

Accordingly, it is an important object of the present invention to provide a press machine having a press frame for adjustably supporting a press bed having increased structural integrity.

Another important object of the present invention is to provide a press machine apparatus for supporting and retaining an abutment member which supports a press bed wherein the tendency of the abutment member to be sheared by the compressive loading of the press bed is reduced.

Still another important object of the present invention is to provide a press bed for use in a press machine wherein the tendency of the frame legs to bow outwardly under compressive loading is reduced.

Yet another important object of the present invention is to provide apparatus for adjustably positioning a press bed on a press machine which is simple in construction and economical to produce while also increasing the structural integrity of the frame.

BRIEF DESCRIPTION OF THE DRAWING

The construction designed to carry out the invention will be hereinafter described, together with other features thereof.

The invention will be more readily understood from a reading of the following specification and by reference to the accompanying drawing forming a part thereof, wherein an example of the invention is shown and wherein.

Description of a Preferred Embodiment

Figure 1:
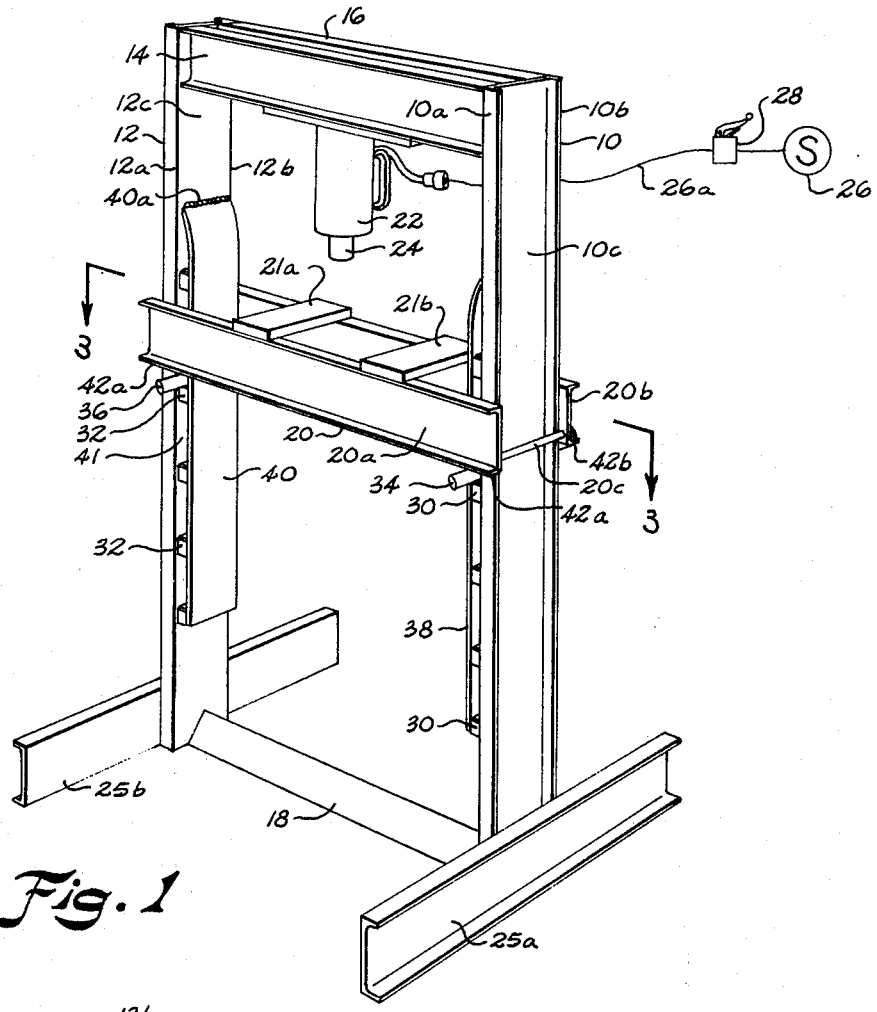
FIG. 1 is a perspective view illustrating a press machine as constructed in accordance with the present invention.

The apparatus of the present invention has application generally to press machines either of the vertical or horizontal type. Since the application would be essentially the same for either type machine, the vertical press machine has been chosen for illustrating a preferred embodiment of the invention, but not for limitation thereto.

The drawing illustrates a press machine having a pair of spaced parallel leg members 10 and 12 which are preferably C-flanges. The leg member 10 has a pair of opposing side flanges 10*a* and 10*b* joined together by a planar web portion 10*c*. The leg member 12 has similar side flanges 12*a* and 12*b* joined together by a planar web portion 12*c*. A cross beam member comprising a pair of C-flange members 14 and 16 bridges the ends of the leg member 10 and 12 adjacent the upper ends thereof. A second cross beam 18 bridges the remote ends of the leg members 10 and 12 for providing a rigid substantially rectangular shaped press frame.

A press bed 20 is slideably arranged over the upright leg members 10 and 12 and is carried transversely by the leg members so as to be adjustable in position along the length of the leg members intermediate the first and second cross beam members 14 and 18.

A jack means 22 is carried by the cross beam member 14 having a ram pin 24 movable towards the press bed 20 for engaging a workpiece supported on the bed. The press bed 20 further comprises a pair of C-flange members 20*a* and 20*b* joined together by a bar member 20*c* such as by welding. The press bed further includes a pair of plate members 21*a* and 21*b* which aid in providing a support for the workpiece on the upper surface of the bed.

A pair of footing plates 25*a* and 25*b* are integrally attached to the frames 10 and 12 such as by welding for maintaining the press frame in an upright position.

The jack means 22 may be any conventional pneumatic, hydraulic, mechanical, or electrical jack head. One such suitable jack head is shown in U.S. Pat. No. 2,387,839. As illustrated, the jack means 22 and ram pin 24 are operated from a source 26 of compressed air. The source 26 is connected to the jack means 22 by means of a supply line 26*a*. A control valve 28 is connected in the supply line 26*a* for selectively admitting pressurized fluid to the jack means 22. The jack means 22 may be a conventional double-acting jack means. Admission of pressurized fluid will move the ram pin 24 in one direction whereupon a second admission of the pressurized fluid will move the ram pin in the opposite direction.

A plurality of abutment supporting elements are provided preferably in the form of rectangular elongated blocks 30 and 32 carried by the frame legs 10 and 12, respectively. The abutment supporting blocks 30 and 32 are preferably attached to the opposing surfaces of the flat web portions 10*c* and 12*c* of the frame legs by welding such as shown at 32*a*. However, other suitable fastening means may be utilized to secure the abutment supporting blocks to the frame legs. It is important that the abutment supporting blocks be attached as truly straight and squarely across the frame legs as possible in order to evenly bear the load of the press bed 20. This is a problem to which considerable attention and cost are required when drilling out holes in conventional machines.

A pair of abutting members 34 and 36, preferably in the form of cylindrical pins are placed and supported on top of the blocks 30 and 32, respectively, for supporting the press bed 20 on the blocks. A lower flange surface of each of the side flanges 20*a* and 20*b* of the press bed 20 is disposed adjacent the leg members 10 and 12 and rests on the abutment members 34 and 36. The abutment members 34 and 36 are removably placed and carried on the abutment supporting blocks 20 and 32 so that the press bed may be adjusted to the desired vertical position on the frame legs.

A pair of bridge members in the form of bridger plates 38 and 40 are carried by the leg members 10 and 12, respectively. The bridger plate 40 extends across and over the abutment supporting blocks 32 to define a space 41 between the leg member 12 and bridger plate 40 between which the abutment member 36 is retained on the supporting block 32. The bridger plate 40 is preferably secured to the leg member 12 by welding at 40*a* and by welding at each of the supporting blocks 32. Each bridger plate spans a sufficient length of the respective leg members, which may be substantially the entire length thereof in some cases, to provide the required structural strengthening. The bridge members may also be welded at both ends to the frame legs for additional strengthening.

In a like manner, the bridger plate 38 is secured to leg 10 and spans the abutment supporting blocks 30 for retaining the abutment member 34. In addition to aiding the retaining of the abutment members 34 and 36 on their respective supporting blocks, the bridger plates 38 and 40 provide increased structural integrity to the leg members 10 and 12 reducing the tendency of the leg members to bow outwardly under increased stress and compressive loading. Although the bridger plates are shown as a single, solid plate, the use of a plurality of narrower, spaced plates is also contemplated.

The strength of the leg members 10 and 12 is further increased by eliminating the need of cutting out material from the frame legs such as when holes are drilled in the side flanges of the frame legs. Furthermore, in conventional press frames wherein holes or cut outs are used, the size of the supporting pin carried therein is limited by the size of the hole or cut out. The size of the hole or cut out is limited by a number of factors, most notably the amount of material which can be removed from the frame legs before critical weakening occurs. In the present invention larger abutment pins 34 and 36 may be utilized for a comparable conventional frame having cut outs. For example, in a seventy-five ton press a one and a half to two inch diameter pin may be easily used whereas in a conventional press of comparable size the pin diameter is normally limited to three-fourths of an inch to one inch. Often use of more than one pin has been required in supporting the press bed in conventional machines due to the size limitations of holes. In this case, holes are necessarily drilled in the press bed frame itself for placement of the additional pins and the press bed is supported by spaced pins. Thus, a stronger and more reliable construction can be had in accordance with the present invention capable of withstanding the increased load demands of heavy duty press machines and eliminating the need for multiple pins.

In addition to strengthening the frame legs 10 and 12 and reducing the tendency of the frame to bow outwardly under increased compressive loading, the apparatus constructed in accordance with the present invention is for adjustably positioning the press bed also reduces the shearing forces on the abutment members 34 and 36 in a manner to be more fully hereinafter explained.

Figure 2:
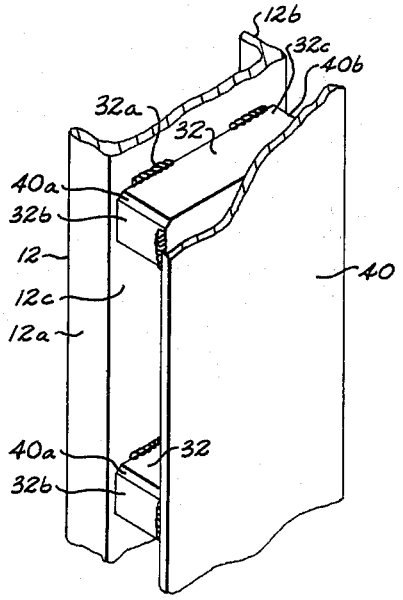
FIG. 2 is an enlarged view with parts broken away illustrating the abutment supporting block and associated structure for adjustably supporting a press bed in accordance with the present invention.
Figure 3:
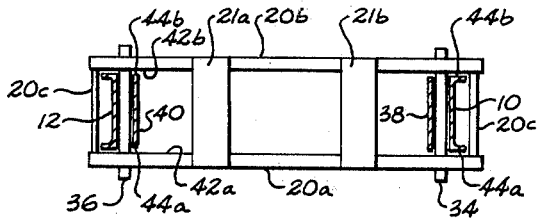
FIG. 3 is a sectional view taken along the line 3—3 of FIG. 1.

Referring to FIG. 2, it can be seen that the upper edges of the opposing ends 32*b* and 32*c* beyond which the abutment member 36 extends when supported and retained thereon are provided with blunted edges such as by beveling at 40*a* and 40*b*. Thus, the normally sharp edge which bears against a pin when inserted in a drilled hole such as found in conventional press machines is eliminated which reduces the tendency of the abutment pin member to be sheared under loading from press bed 20. The beveled edges 40*a* and 40*b* present a substantially rounded, rather smooth surface over which the abutment pin 36 tends to bend rather than shear.

Furthermore, the lowermost edges 42*a* and 42*b* of the press bed sides 20*a* and 20*b*, respectively, which are closest to the frame legs 10 and 12, are offset from the adjacent end surfaces of the support blocks 30 and 32 to define an offset space 44*a* and 44*b* therebetween. This offset distance provides spaced points of contact on the abutment members 34 and 36 between the lowermost edges 42*a* and 42*b* and the edges of the supporting blocks 30 and 32, which reduces the tendency of the abutment pin members 34 and 36 to shear under the loading of the press bed. In other words, the lowermost edges 42*a* and 42*b* contact the abutment pin members 34 and 36 at a point spaced from the point at which the top of the beveled edges 40*a* and 40*b* contacts the abutment pin members. Thus, a bending force rather than a shear force is exerted on the abutment pins 34 and 36 by the press bed 20. In the preferred embodiment, the offset space distance is approximately one-quarter of an inch.

All of the various elements of the press frame, not already specifically referred, are preferably attached to one another by welding to provide an integral construction for the press machine.

Thus, it can be seen that an advantageous construction for a press machine can be had in accordance with the present invention wherein the press bed can be adjustably supported on the press frame having increased structural integrity and reliability. Construction in accordance with the present invention avoids the necessity in conventional machinery of the precision drilling of material out of the frame legs which is costly in terms of manufacturing costs and structural strength. Stronger frame leg and press machine structure is provided by the apparatus of the present invetion which adjustably supports the press bed.

While a preferred embodiment of the invention has been described using specific terms, such description is for illustrative purposes only, and it is to be understood that changes and variations may be made without departing from the spirit or scope of the following claims.

What is claimed is:

1. In a frame for a press machine having a pair of spaced parallel leg members, a cross beam member bridging the ends of said leg members adjacent one of the ends thereof, a second cross beam member bridging the remote ends of said leg members, a press bed carried transversely by said leg members being adjustable in position along the length thereof intermediate said first and second cross beam members, a jack means carried by said first cross beam member having a ram pin movable towards said press bed for engaging a workpiece supported on said bed, the improvement comprising at least one abutment supporting element integrally carried on each of said leg members for supporting an abutment member, said press bed having a lower most edge surface disposed adjacent said leg members for being supported on said abutment members when placed on said supporting elements at a desired position along the length of said leg members, and a bridge member carried by said frame adjacent each said leg member extending over said abutment supporting element to define a space between a respective leg member and bridge member between which said abutment member is retained on said supporting element while providing increased strength to said leg members and frame reducing the tendency of said leg members to bow outwardly under increased stress.

2. The apparatus as set forth in claim 1 wherein a plurality of said abutment supporting elements are carried in spaced parallel relationship along the length of said leg member wherein each element includes an elongated block element having at least one planar surface.

3. The apparatus as set forth in claim 1 wherein upper edges of opposing ends of said abutment supporting elements beyond which said abutment member extends when supported and retained thereon are blunted for reducing the sharp edge thereof and the tendency of said abutment member to be sheared when said press bed supported thereon is under load.

4. The apparatus as set forth in claim 1 wherein said abutment supporting elements are carried on the inside opposing surfaces of said leg members.

5. The apparatus as set forth in claim 1 wherein said lowermost edge of said press bed supported on said abutment members is offset from adjacent end surfaces of said supporting elements upon which said abutment member is supported providing spaced points of contact on said abutment members between said lowermost edge and the edge of said supporting elements reducing the shearing effect of said press bed on said abutment member.

6. The apparatus as set forth in claim 1 wherein said bridge member includes a solid plate member.

* * * * *